US010587066B2

(12) United States Patent
Ho

(10) Patent No.: US 10,587,066 B2
(45) Date of Patent: Mar. 10, 2020

(54) ELECTRICAL CONNECTOR

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/242,349

(22) Filed: Jan. 8, 2019

(65) Prior Publication Data

US 2019/0221956 A1 Jul. 18, 2019

(30) Foreign Application Priority Data

Jan. 12, 2018 (CN) ..... 2018 1 0029591

(51) Int. Cl.
*H01R 13/24* (2006.01)
*H01R 12/55* (2011.01)
(Continued)

(52) U.S. Cl.
CPC ..... *H01R 13/2464* (2013.01); *H01R 12/52* (2013.01); *H01R 12/55* (2013.01); *H01R 12/7076* (2013.01); *H01R 12/714* (2013.01); *H01R 13/2457* (2013.01); *H01R 13/2485* (2013.01); *H01R 13/40* (2013.01);
(Continued)

(58) Field of Classification Search
CPC .... H01R 12/57; H01R 12/714; H01R 12/716; H01R 12/2442; H01R 12/7076; H01R 13/245; H05K 3/3436; H05K 7/1061
See application file for complete search history.

(56) References Cited

U.S. PATENT DOCUMENTS 6,976,888 B2 * 12/2005 Shirai ..... H01R 13/2442 439/733.1
7,791,443 B1 * 9/2010 Ju ..... H01R 12/52 336/107
(Continued)

FOREIGN PATENT DOCUMENTS

CN 204156172 U 2/2015
CN 107093827 A 8/2017
(Continued)

*Primary Examiner* — Oscar C Jimenez
(74) *Attorney, Agent, or Firm* — Locke Lord LLP; Tim Tingkang Xia, Esq.

(57) ABSTRACT

An electrical connector used to be electrically connected to a chip module includes a body provided with multiple accommodating holes running through the body and at least one accommodating grooves. Each accommodating groove is formed between two adjacent accommodating holes to communicate the two adjacent accommodating holes with each other. Multiple terminals are correspondingly accommodated in the accommodating holes respectively. Each terminal includes a base and an elastic portion bending and extending upward from the base, and the elastic portion upward abuts the chip module. Each accommodating groove correspondingly accommodates the base of one of the terminals. Each accommodating groove is used for lowering strength of the body. When the electrical connector is soldered to a circuit board by high-temperature heating, the body is prone to be softened under the high temperature and thus becomes smooth, such that warping occurring during forming of the body is eliminated.

11 Claims, 8 Drawing Sheets

(51) Int. Cl.

| | |
|---|---|
| ***H01R 12/52*** | (2011.01) |
| ***H01R 12/70*** | (2011.01) |
| ***H01R 13/40*** | (2006.01) |
| ***H01R 13/502*** | (2006.01) |
| ***H01R 13/514*** | (2006.01) |
| ***H01R 12/71*** | (2011.01) |
| ***H01R 13/428*** | (2006.01) |

(52) U.S. Cl.
CPC ..... *H01R 13/428* (2013.01); *H01R 13/502* (2013.01); *H01R 13/514* (2013.01)

(56) References Cited

U.S. PATENT DOCUMENTS 8,708,716 B1 * 4/2014 Ho ..... H01R 12/714 439/83
9,033,737 B2 * 5/2015 Chang ..... H01R 13/6588 439/607.05
9,954,312 B1 * 4/2018 Ju ..... H01R 12/707
2012/0171897 A1 * 7/2012 Ju ..... H01R 13/41 439/607.01
2012/0196481 A1 * 8/2012 Ju ..... H01R 13/6588 439/626
2012/0252274 A1 * 10/2012 Ju ..... H01R 12/716 439/626
2013/0183861 A1 * 7/2013 Chang ..... H05K 7/1069 439/607.35
2016/0134037 A1 * 5/2016 Ju ..... H01R 13/2407 439/660
2018/0269613 A1 * 9/2018 Ju ..... H01R 12/7076
2018/0331442 A1 * 11/2018 Huang ..... H01R 12/714
2018/0366881 A1 * 12/2018 Chang ..... H01R 13/6588

FOREIGN PATENT DOCUMENTS

CN 206461121 U 9/2017
CN 206532913 U 9/2017
CN 107230851 A 10/2017

* cited by examiner

100

2

C–C

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810029591.3 filed in China on Jan. 12, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector used for electrically connecting a chip module.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector is located between a chip module and a circuit board, and is used for electrically connecting the chip module and the circuit board. The existing electrical connector mainly includes an insulating body and conductive terminals accommodated in the insulating body. The conductive terminals upward abut the chip module, and downward abut the circuit board, thereby achieving signal transmission between the chip module and the circuit board.

Currently, electronic products tend to develop in the lighting and thinning direction, and the chip module needs to process more and more information, such that the number of conductive terminals thereof may generally be as many as thousands. Correspondingly, the insulating body needs to have large enough strength to allow all the conductive terminals to be assembled therein. Further, warping occurs easily in the forming process of the insulating body. When the insulating body is soldered to the circuit board by high-temperature heating, the strength of the insulating body is large, resulting in the insulating body under high temperature still maintaining the warping in the forming, which further results in that part of the conductive terminals in the insulating body cannot be in contact with the circuit board, causing a high risk of missing solder during soldering of the conductive terminals and the circuit board, and affecting normal electrical conduction between the electrical connector and the circuit board, such that the chip module cannot work normally.

Therefore, a heretofore unaddressed need to design a new electrical connector exists in the art to address the aforementioned deficiencies and inadequacies.

SUMMARY

In view of the above deficiencies, the present invention is directed to an electrical connector capable of effectively eliminating body warping and enabling a chip module to work normally by lowering strength of a body.

To achieve the foregoing objective, the present invention adopts the following technical solutions.

An electrical connector is configured to be electrically connected to a chip module, and includes: a body, provided with a plurality of accommodating holes running through the body and at least one accommodating groove, wherein each of the at least one accommodating groove is formed between two adjacent ones of the accommodating holes to communicate the two adjacent ones of the accommodating holes with each other; and a plurality of terminals, correspondingly accommodated in the accommodating holes respectively, wherein each of the terminals includes a base and an elastic portion bending and extending upward from the base, and the elastic portion upward abuts the chip module; wherein each of the at least one accommodating groove correspondingly accommodates the base of one of the terminals.

In certain embodiments, the body is provided with a plurality of accommodating grooves, at least one of the accommodating holes has two adjacent accommodating holes, and one of the accommodating grooves is provided between the at least one of the accommodating holes and each of the two adjacent accommodating holes.

In certain embodiments, two opposite sides of the base are respectively provided with two fixing portions, and the two fixing portions are respectively fixed to two corresponding ones of the accommodating grooves.

In certain embodiments, the base comprises a through hole running through the base, and the two fixing portions are located at two opposite sides of the through hole. In certain embodiments, the body is provided with a plurality of accommodating grooves, at least one accommodating hole has four adjacent accommodating holes respectively at four corners thereof, and one of the accommodating grooves is provided between each of the four corners of at least one accommodating hole and each of the four adjacent accommodating holes.

In certain embodiments, each of the at least one accommodating groove has a position limiting surface located below the base, and configured to limit the one of the terminals from moving downward.

In certain embodiments, one side of the base of the one of the terminals has a fixing portion in interference fit with one of the at least one accommodating groove. In certain embodiments, at least one of the accommodating holes has a groove provided adjacent to a corresponding one of the at least one accommodating groove, and the groove does not run downward through the body.

In certain embodiments, a bottom surface of each of the at least one accommodating groove is lower than that of the groove.

In certain embodiments, a strip connecting portion is formed by extending upward from the base and is configured to be connected to a strip, and the strip connecting portion is at least partially accommodated in a corresponding one of the at least one accommodating groove.

In certain embodiments, a supporting portion is formed by extending upward from the body and is configured to upward support the chip module, and the supporting portion is connected to one side of a corresponding one of the at least one accommodating groove.

In certain embodiments, the elastic portion comprises a first portion extending from the base toward a direction away from a vertical plane where the base is located, and a second portion formed by bending and extending reversely from the first portion to pass beyond the vertical plane where the base is located, the second portion has a contact portion abutting the chip module, and the first portion and the contact portion are located on two opposite sides of a corresponding one of the at least one accommodating groove accommodating the base.

In certain embodiments, the accommodating holes are formed in a plurality of rows in a front-rear direction, two adjacent rows of accommodating holes are staggered in the front-rear direction, and two adjacent accommodating holes in the front-rear direction partially overlap with each other in the front-rear direction.

In certain embodiments, the two adjacent accommodating holes are connected to each other at an overlapping position thereof.

Compared with the related art, the electrical connector according to certain embodiments of the present invention has the beneficial effects:

Each of the at least one accommodating groove communicates two adjacent accommodating holes with each other, and the at least one accommodating groove is used for lowering the strength of the body. When the electrical connector is soldered to a circuit board by high-temperature heating, the body is prone to be softened under the high temperature and thus becomes smooth, such that warping occurring during forming of the body is eliminated, preventing from the risk of missing soldering during soldering of the electrical connector and the circuit board. Further, the base is accommodated in the corresponding one of the at least one accommodating groove. When soldering of the electrical connector is completed, the base can limit the body from warping again when the temperature lowers, ensuring normal electrical conduction between the electrical connector and the circuit board, such that the chip module can normally work.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
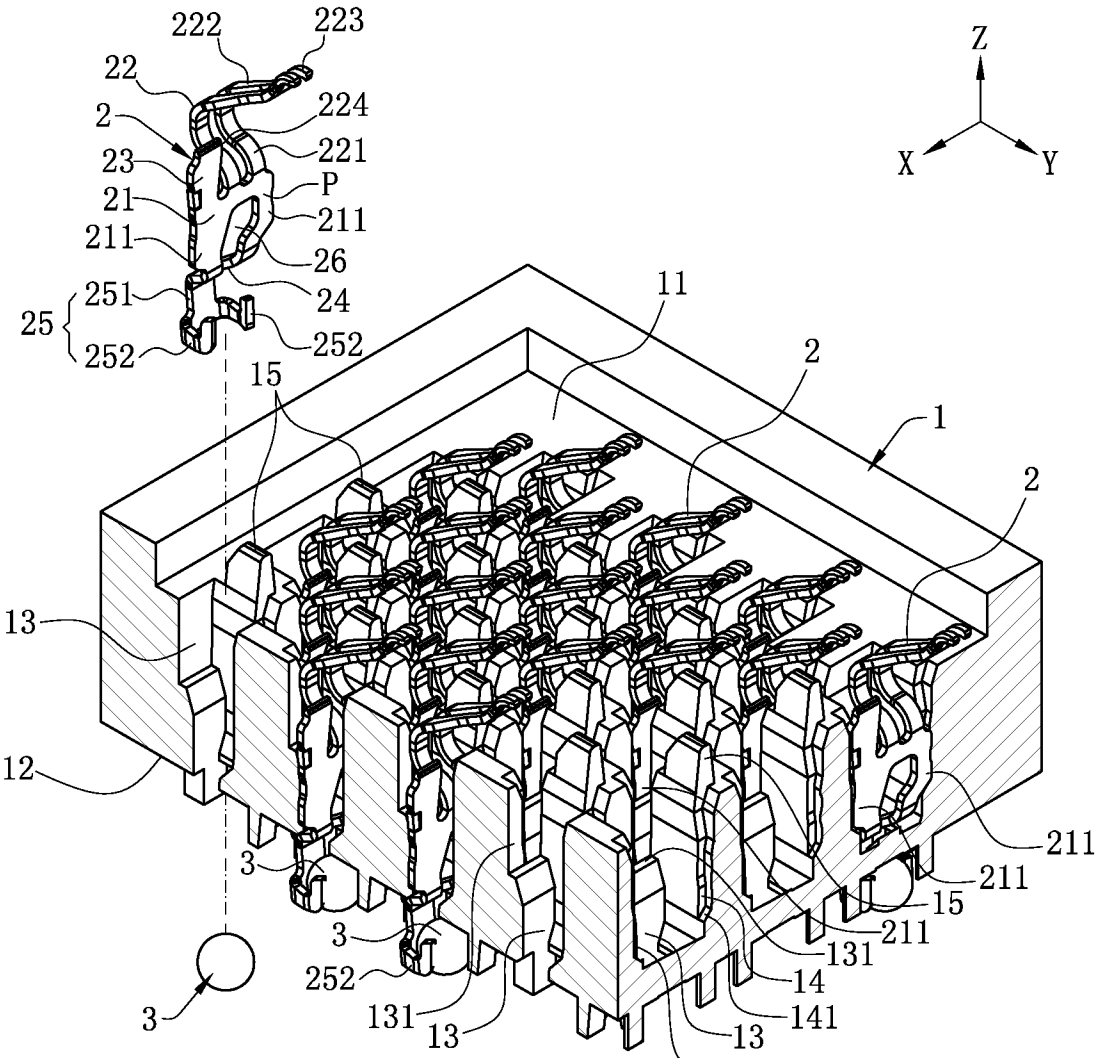
FIG. 1 is a perspective view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

As shown in FIG. 1, in the electrical connector 100 according to certain embodiments of the present invention, a vertical direction Z, and a left-right direction X and a front-rear direction Y respectively perpendicular to the vertical direction Z are defined.

Figure 6:
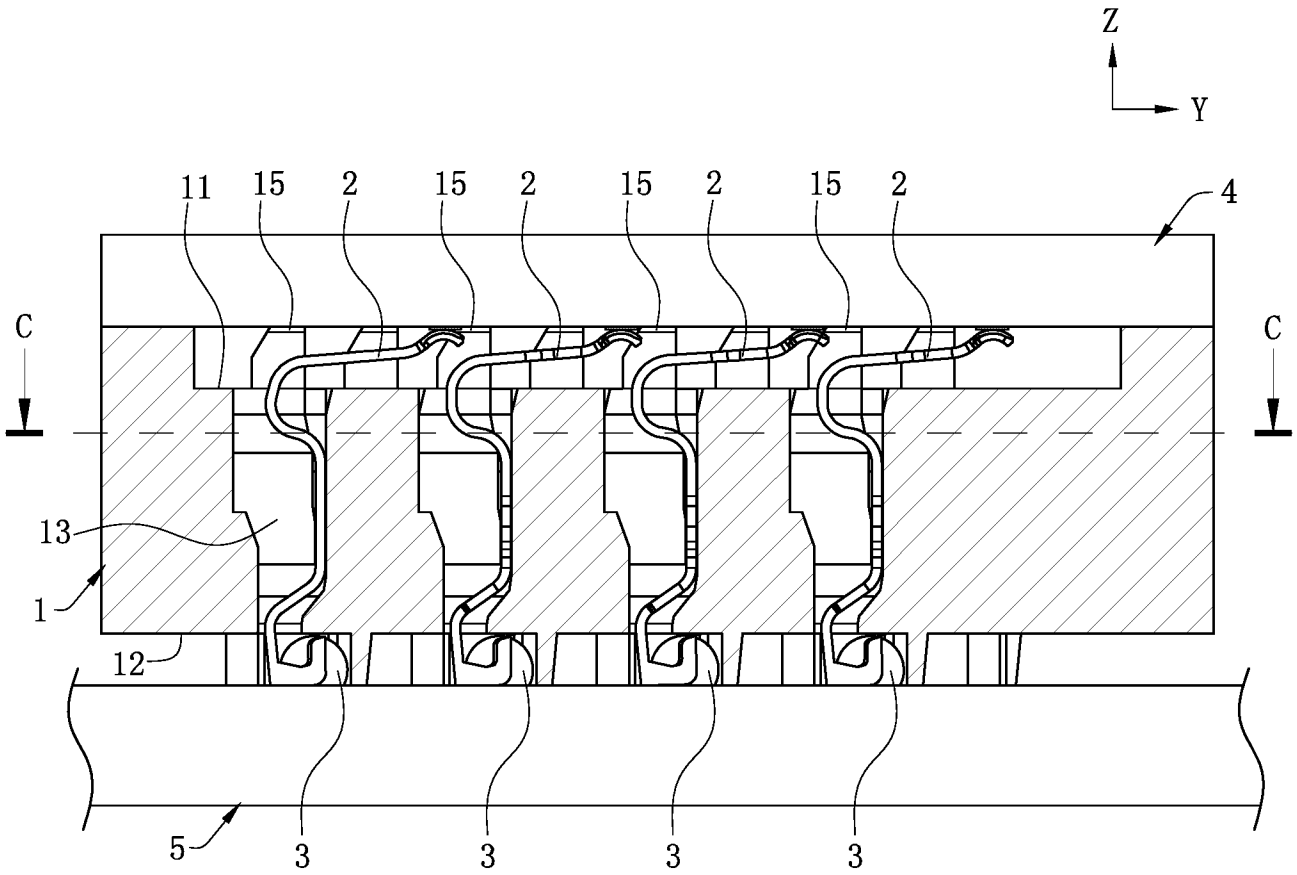
FIG. 6 is a plain view of the electrical connector in FIG. 5 after downward pressing of a chip module.

As shown in FIG. 1 and FIG. 6, the electrical connector 100 according to certain embodiments of the present invention is used for electrically connecting a chip module 4 to a circuit board 5. The electrical connector 100 includes a body 1 used for upward supporting the chip module 4, and a plurality of terminals 2 accommodated in the body 1. One end of each terminal 2 elastically abuts the chip module 4, and the other end of each terminal 2 is soldered to the circuit board 5 through a solder 3.

As shown in FIG. 1, the body 1 is made of an insulating material. The body 1 has an upper surface 11 and a lower surface 12 opposite to each other, and the body 1 is provided with a plurality of accommodating holes 13 running through the upper surface 11 and the lower surface 12 vertically.

Figure 7:
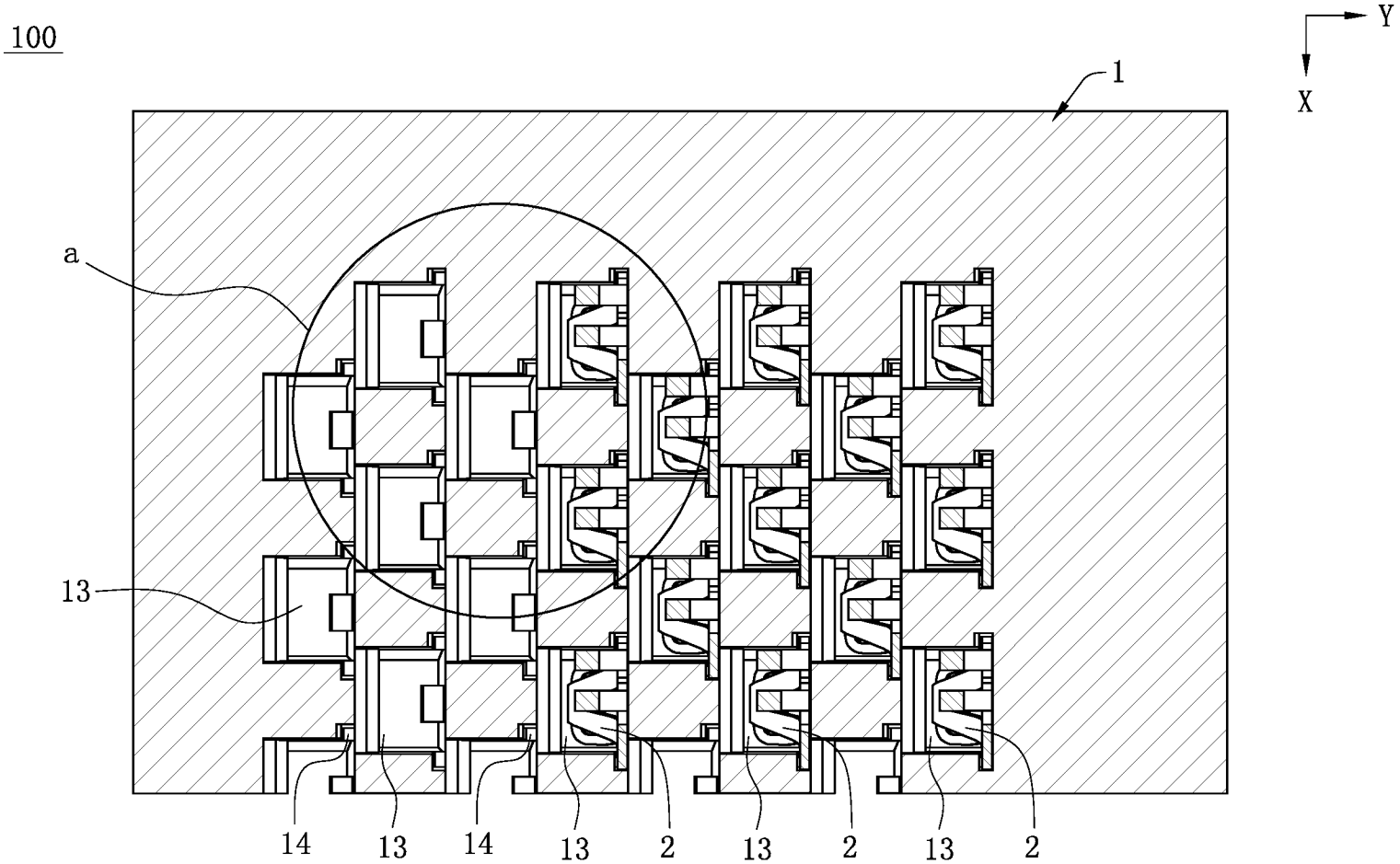
FIG. 7 is a sectional view of the electrical connector in FIG. 6 in a C-C direction.
Figure 8:
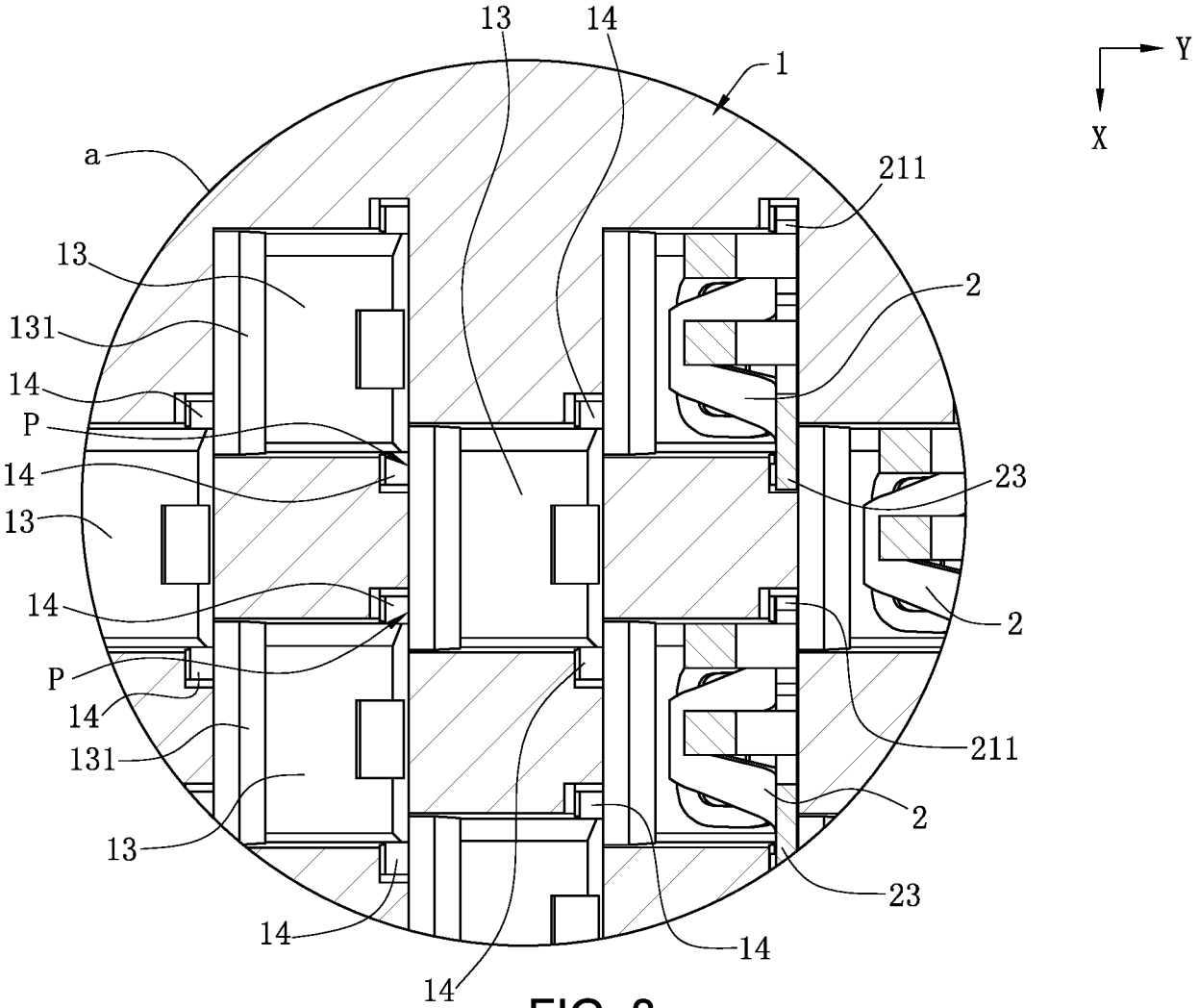
FIG. 8 is an enlarged view of a portion a in FIG. 7.

As shown in FIG. 7 and FIG. 8, the accommodating holes 13 are distributed in a plurality of rows in the front-rear direction Y. Two adjacent rows of the accommodating holes 13 are staggered in the front-rear direction Y, and two front-rear adjacent accommodating holes 13 partially overlap with each other in the front-rear direction Y, such that distribution of the accommodating holes 13 is more compact. The two front-rear adjacent accommodating holes 13 are connected to each other at an overlapping position P thereof, so as to lower strength of the body 1.

As shown in FIG. 1 and FIG. 8, the body 1 is provided with a plurality of accommodating grooves 14, wherein each of the accommodating grooves 14 is formed between two adjacent accommodating holes 13 to communicate the two adjacent accommodating holes 13 with each other. The accommodating groove 14 is downward concavely provided on the upper surface 11, and the accommodating groove 14 does not run through the lower surface 12 so as to form a position limiting surface 141. In other embodiments, there may be only one accommodating groove 14 formed between two adjacent accommodating holes 13 to communicate with the two adjacent accommodating holes 13.

As shown in FIG. 7 and FIG. 8, at least one accommodating hole 13 has two adjacent accommodating holes 13, and an accommodating groove 14 is provided between the at least one accommodating hole 13 and each of its two adjacent accommodating holes 13. The two accommodating grooves 14 enables the at least one accommodating hole 13 to communicate with its two adjacent accommodating holes 13. In this embodiment, each accommodating hole 13 located in a center area of the body 1 is correspondingly provided with two accommodating grooves 14. In other embodiments, there may be only one accommodating hole 13 correspondingly provided with two accommodating grooves 14.

At least one accommodating hole 13 has four adjacent accommodating holes 13 respectively at four corners thereof, and an accommodating grooves 14 is provided between each of the four corners of the at least one accommodating hole 13 and each of its four adjacent accommodating holes 13. The four accommodating grooves 14 enable the four corners of the at least one accommodating hole 13 to communicate with its four adjacent accommodating holes 13. In this embodiment, each accommodating hole 13 located in the center area of the body 1 is correspondingly provided with the accommodating grooves 14 at its four corners. In other embodiments, there may be only one accommodating hole 13 correspondingly provided with the accommodating grooves 14 at its four corners.

Figure 5:
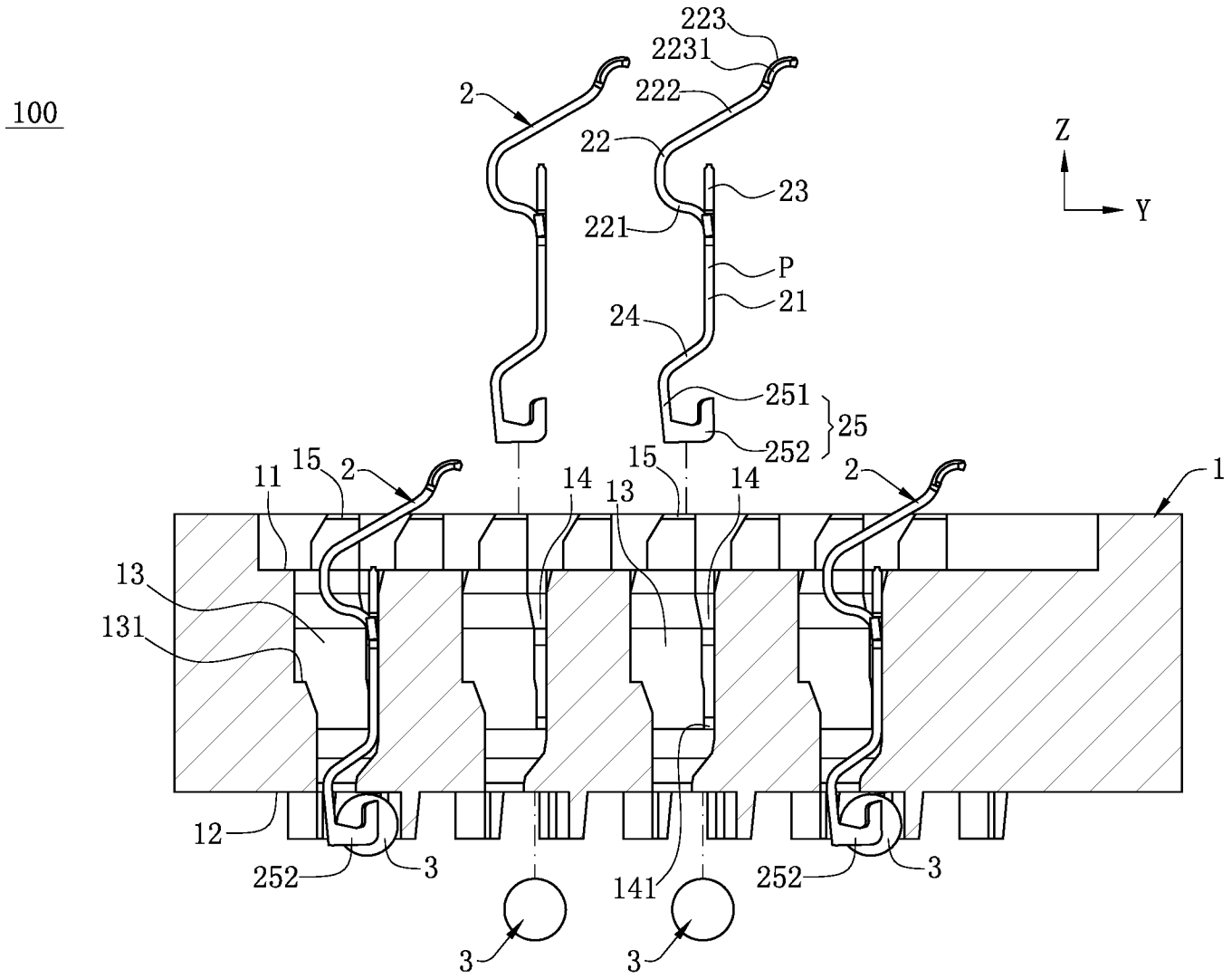
FIG. 5 is a sectional view of the electrical connector in FIG. 3 in a B-B direction.

As shown in FIG. 1, FIG. 5 and FIG. 8, at least one accommodating hole 13 has a groove 131 adjacent to the corresponding accommodating groove 14. The groove 131 is connected with its two adjacent accommodating grooves 14, and the groove 131 does not run downward through the body 1. A bottom surface (namely the position limiting surface 141) of each accommodating groove 14 is lower than a bottom surface of the groove 131. In this embodiment, each accommodating hole 13 located in the center area of the body 1 has the groove 131. In other embodiments, there may be only one accommodating hole 13 correspondingly provided with the groove 131, and the groove 131 may also be only connected with its one adjacent accommodating groove 14.

As shown in FIG. 1 and FIG. 6, the body 1 further includes a supporting portion 15 extending upward from the upper surface 11, and used for upward supporting the chip module 4. The supporting portion 15 is connected to one side of a corresponding accommodating groove 14. In this embodiment, a plurality of supporting portions 15 are provided, and each is correspondingly provided on one side of each of the accommodating holes 13 respectively.

Figure 2:
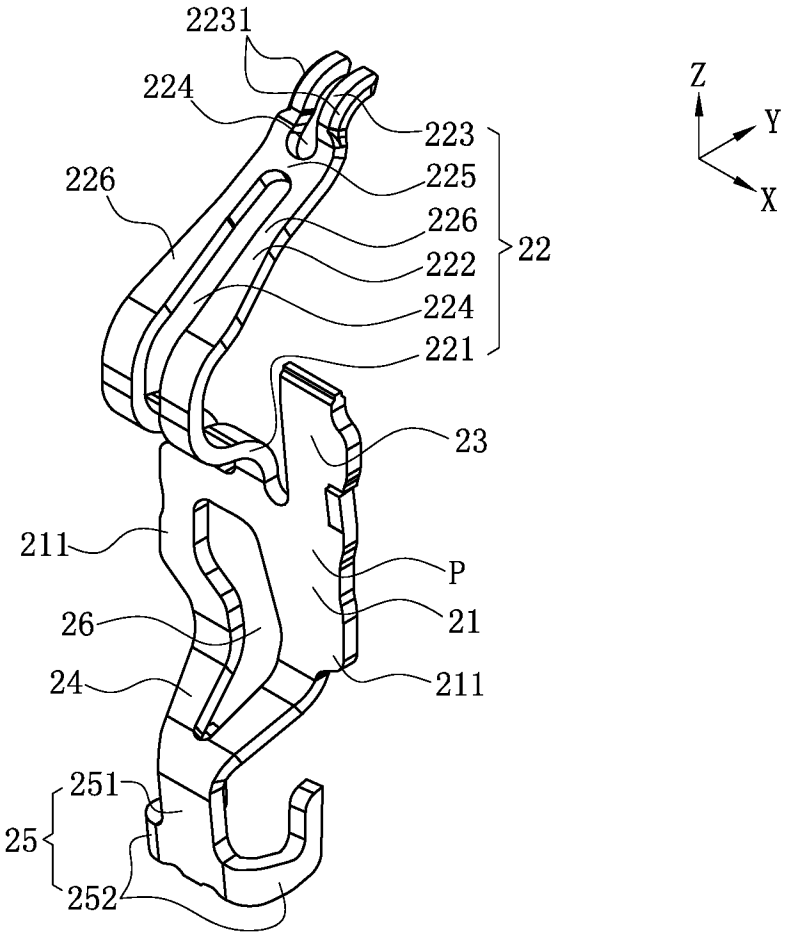
FIG. 2 is a perspective view of a terminal in FIG. 1 viewing from another angle.
Figure 3:
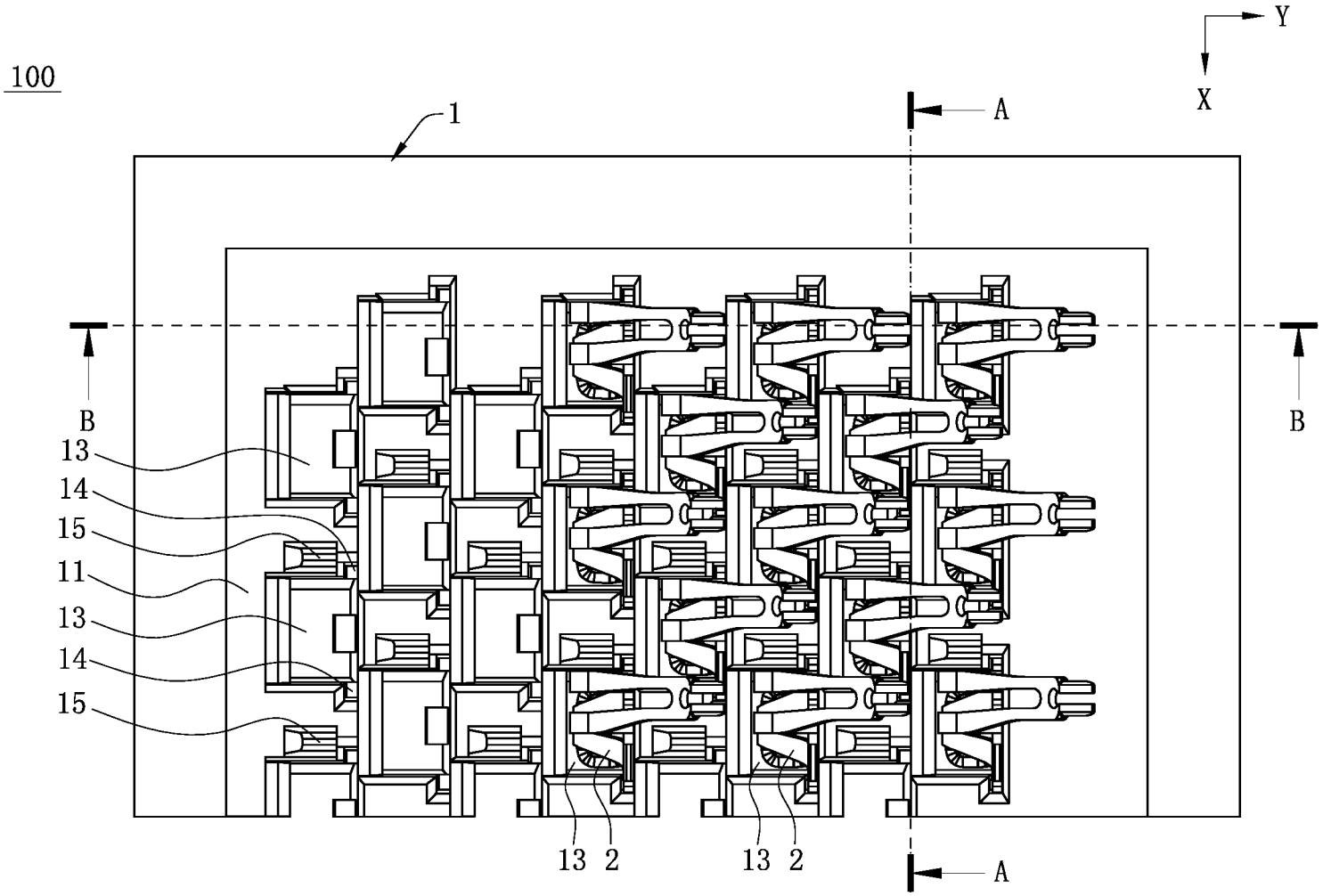
FIG. 3 is a top view of the electrical connector in FIG. 1.

As shown in FIG. 1 and FIG. 2, the terminals 2 are correspondingly accommodated in the accommodating holes 13 respectively. Each terminal 2 is formed by stamping of sheet metal, and each terminal 2 includes a base 21, an elastic portion 22, a strip connecting portion 23, a bending portion 24 and a conducting portion 25.

Figure 4:
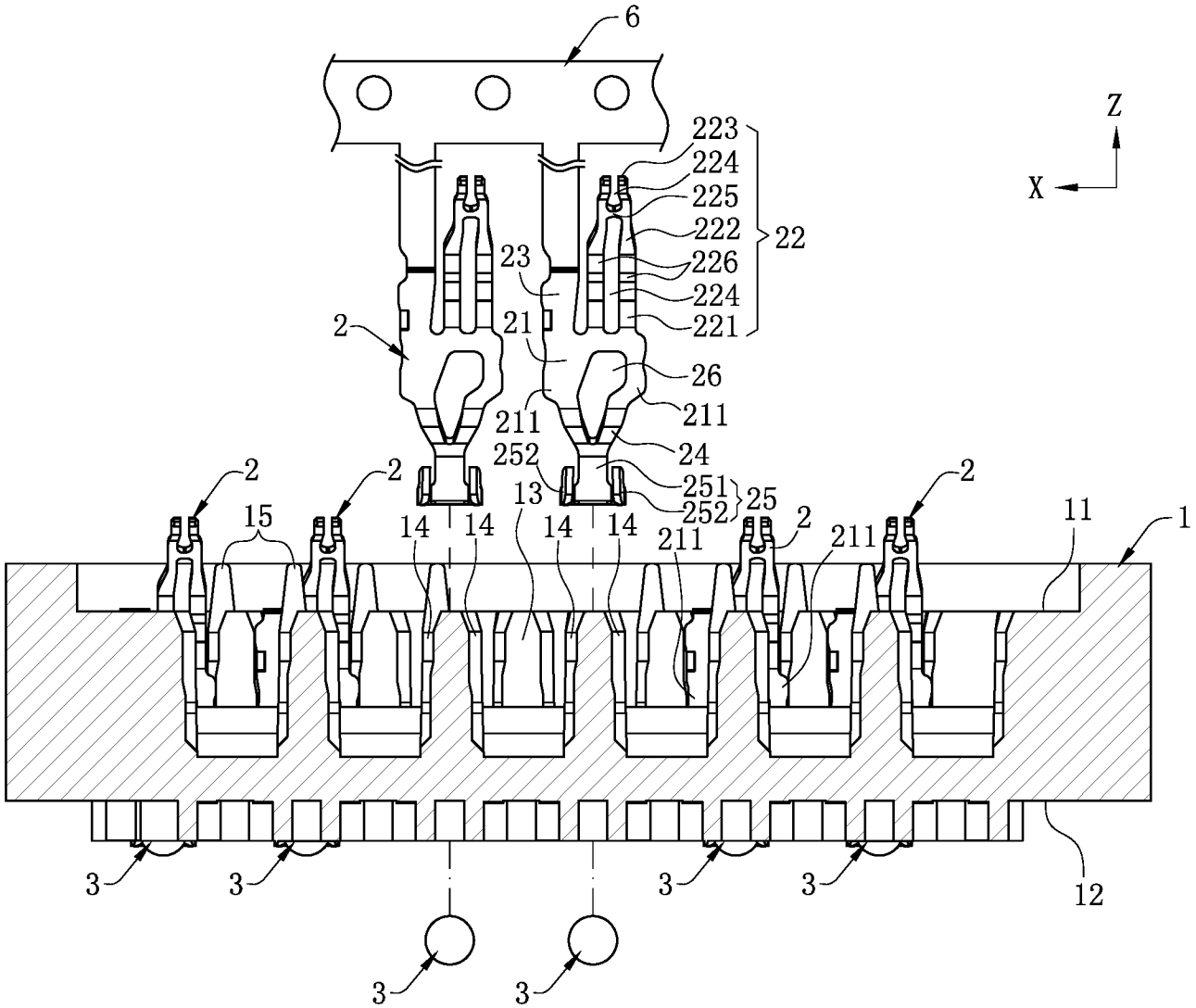
FIG. 4 is a sectional view of the electrical connector in FIG. 3 in an A-A direction.

As shown in FIG. 2 and FIG. 4, the base 21 is accommodated in a corresponding the accommodating hole 13 and is partially accommodated in a corresponding accommodating groove 14. One side of the base 21 has a fixing portion 211 fixed to the corresponding accommodating groove 14. In this embodiment, each of two opposite sides of the base 21 of each terminal 2 accommodated in a center position of the body 1 has a fixing portion 211, and the two fixing portions 211 are respectively fixed to two corresponding accommodating grooves 14. In other embodiments, each terminal 2 may have only one fixing portion 211, and the fixing portion 211 is fixed to one corresponding accommodating groove 14.

An outer side of the fixing portion 211 is in interference fit with an inner wall surface of the corresponding accommodating groove 14 for fixing the terminal 2, and the position limiting surface 141 is located below the fixing portion 211 for limiting the terminal 2 from moving downward.

As shown in FIG. 2 and FIG. 5, the elastic portion 22 is formed by bending upward and extending from the base 21, and extends to pass beyond the corresponding accommodating hole 13. The elastic portion 22 is used for abutting the chip module 4, and the bottom surface of the groove 131 and the elastic portion 22 are provided in a staggered manner in the vertical direction Z.

The elastic portion 22 includes a first portion 221 extending from the base 21 toward a direction away from a vertical plane P where the base 21 is located, and a second portion 222 formed by bending and extending reversely from the first portion 221 to pass beyond the vertical plane P where the base 21 is located. Such configuration aims to increase the elasticity of the elastic portion 22, thereby ensuring good electrical conduction of the terminal 2 and the chip module 4.

The second portion 222 has a contact portion 223 which is arc-shaped and abuts the chip module 4. The first portion 221 and the contact portion 223 are located at two opposite sides of the corresponding accommodating groove 14 accommodating the base 21. Two opposite outer sides of an upper surface of the contact portion 223 are respectively inclined downward to form two chamfers 2231. The chamfers 2231 reduce a contact area of the contact portion 223 and the chip module 4, lowering a risk that the contact portion 223 slides out of a pad of the chip module 4.

As shown in FIG. 2 and FIG. 4, the elastic portion 22 further includes a through slot 224 and a beam 225. The through slot 224 runs through the second portion 222 vertically and extends to a connecting location of the first portion 221 and the base 21. The through slot 224 makes the elastic portion 22 form two branches 226 at two opposite sides of the through slot 224, increasing a length of the through slot 224 in the elastic portion 22 to a maximum extent, lowering a self-inductance effect of the elastic portion 22, reducing crosstalk interference between adjacent terminals 2, and increasing the elasticity of the elastic portion 22.

The through slot 224 runs through a free end of the contact portion 223, such that the contact portion 223 forms two free ends. The beam 225 is provided on the second portion 222 and connects to the two branches 226. The beam 225 can prevent the two branches 226 from excessively moving away from each other, ensuring good electrical contact of the contact portion 223 and the chip module 4.

The strip connecting portion 23 is formed by extending upward from the base 21, and is used for connecting a strip 6. The strip connecting portion 23 is partially accommodated in the corresponding accommodating groove 14, and the strip connecting portion 23 extends upward to pass beyond the corresponding accommodating groove 14. In other embodiments, the strip connecting portion 23 may be completely accommodated in the corresponding accommodating groove 14.

The bending portion 24 is formed by bending and extending downward from the base 21. A width of the bending portion 24 in its extending direction is gradually decreased, so as to increase the elasticity of the bending portion 24. The bending portion 24 and the first portion 221 are located on a same side of the vertical plane P where the base 21 is located (referring to FIG. 5).

The conducting portion 25 is formed by bending and extending from the bending portion 24, and is used for electrically connecting the circuit board 5. The conducting portion 25 includes a connecting portion 251 obliquely extending downward from the bending portion 24, and two clamping portions 252 bending and extending from two opposite sides of the connecting portion 251.

As shown in FIG. 1, FIG. 4 and FIG. 5, the two clamping portions 252 are located below the lower surface 12, and the body 1 stops the two clamping portions 252 for limiting the terminal 2 from moving upward. The two clamping portions 252 jointly clamp the solder 3, such that the terminal 2 is soldered to the circuit board through the solder 3.

Each terminal 2 further includes a through hole 26. The through hole 26 runs through the base 21 and the bending portion 24, so as to reduce the inductance effect of the terminal 2. The through hole 26 does not run through the conducting portion 25, ensuring sufficient strength of the conducting portion 25, and the two fixing portions 211 are located at two opposite sides of the through hole 26.

During assembling, the terminal 2 is installed in the corresponding accommodating hole 13 from top to bottom through the strip 6, such that the base 21 is accommodated in the accommodating hole 13, and the fixing portion 211 is accommodated in the accommodating groove 14, until the fixing portion 211 abuts the position limiting surface 141. The fixing portion 211 is in interference fit with the accommodating groove 14, and the two clamping portions 252 move to be below the body 1. Finally, the strip 6 is broken off and taken away, and the solder 3 is installed between the two clamping portions 252 from bottom to top.

As shown in FIG. 6, in use, firstly, the electrical connector 100 is placed on the circuit board 5, and the electrical connector 100 is soldered and fixed to the circuit board 5 through the solder 3. Then, the chip module 4 is installed on the electrical connector 100, and a downward action force is applied to the chip module 4, such that the chip module 4 presses downward on the terminal 2, until the supporting portion 15 upward supports the chip module 4, and the chip module 4 can be electrically connected to the circuit board 5.

To sum up, the electrical connector according to certain embodiments of the present invention have the following beneficial effects:

(1) Each of the at least one accommodating groove 14 enables two adjacent accommodating holes 13 to communicate with each other, and the at least one accommodating groove 14 is used for lowering the strength of the body 1. When the electrical connector 100 is soldered to the circuit board 5 by high-temperature heating, the body 1 is prone to be softened under the high temperature and thus becomes smooth, such that warping occurring during forming of the body 1 is eliminated, preventing from the risk of missing soldering during soldering of the electrical connector 100 and the circuit board 5. Further, the base 21 is accommodated in the corresponding accommodating groove 14. When soldering of the electrical connector 100 is completed, the base 21 can limit the body 1 from warping again when the temperature lowers, ensuring normal electrical conduction between the electrical connector 100 and the circuit board 5, such that the chip module 4 can normally work.

(2) At least one accommodating hole 13 has two adjacent accommodating holes 13, and an accommodating groove 14 is provided between the at least one accommodating hole 13 and each of its two adjacent accommodating holes 13. The two accommodating grooves 14 enables the at least one accommodating hole 13 to communicate with its two adjacent accommodating holes 13, such that the strength of the body 1 can be further lowered, thereby further eliminating warping occurring during forming of the body 1 in the high-temperature heating and soldering process.

(3) At least one accommodating hole 13 has four adjacent accommodating holes 13 respectively at four corners thereof, and an accommodating grooves 14 is provided between each of the four corners of the at least one accommodating hole 13 and each of its four adjacent accommodating holes 13. The four accommodating grooves 14 enable the four corners of the at least one accommodating hole 13 to communicate with its four adjacent accommodating holes 13, such that the strength of the body 1 can be further lowered, thereby further eliminating warping occurring during forming of the body 1 in the high-temperature heating and soldering process.

(4) The position limiting surface 141 is located below the fixing portion 211 for limiting the terminal 2 from moving downward. When soldering of the body 1 is completed, by the base 21 and the position limiting surface 141 limiting each other, the body 1 can be effectively prevented from warping again due to temperature lowering.

(5) At least one accommodating hole 13 has a groove 131 adjacent to the corresponding accommodating groove 14. The groove 131 can further lower the strength of the body 1. Further, the groove 131 does not run downward through the body 1, ensuring the connecting strength between adjacent accommodating holes 13.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a chip module, comprising: a body, provided with a plurality of accommodating holes running through the body and a plurality of accommodating grooves, wherein the accommodating holes are formed in a plurality of rows in a front-rear direction, two of the rows of the accommodating holes adjacent in the front-rear direction are staggered, two adjacent ones of the accommodating holes in the front-rear direction partially overlap with each other in the front-rear direction, each of the accommodating grooves is formed between the two adjacent ones of the accommodating holes in the front-rear direction to communicate the two adjacent ones of the accommodating holes in the front-rear direction with each other, one of the accommodating holes in one row of the rows has four adjacent accommodating holes in two adjacent rows of the rows, the four adjacent accommodating holes in the two adjacent rows are respectively located at four corners of the one of the accommodating holes in the one row, and one of the accommodating grooves is provided between each of the four corners of the one of the accommodating holes in the one row and each of the four adjacent accommodating holes in the two adjacent rows; and a plurality of terminals, correspondingly accommodated in the accommodating holes respectively, wherein each of the terminals comprises a base and an elastic portion bending and extending upward from the base, and the elastic portion upward abuts the chip module; wherein each of the accommodating grooves correspondingly accommodates the base of one of the terminals, and a portion of the base being accommodated in the corresponding accommodating groove is exposed forward to a front accommodating hole of the two adjacent ones of the accommodating holes in the front-rear direction.

2. The electrical connector according to claim 1, wherein two opposite sides of the base are respectively provided with two fixing portions, and the two fixing portions are respectively fixed to two corresponding ones of the accommodating grooves.

3. The electrical connector according to claim 2, wherein the base comprises a through hole running through the base, and the two fixing portions are located at two opposite sides of the through hole.

4. The electrical connector according to claim 1, wherein each of the accommodating grooves has a position limiting surface located below the base, and configured to limit the one of the terminals from moving downward.

5. The electrical connector according to claim 1, wherein one side of the base of the one of the terminals has a fixing portion in interference fit with one of the accommodating grooves.

6. The electrical connector according to claim 1, wherein at least one of the accommodating holes has a groove provided adjacent to a corresponding one of the accommodating grooves, and the groove does not run downward through the body.

7. The electrical connector according to claim 6, wherein a bottom surface of each of the accommodating grooves is lower than that of the groove.

8. The electrical connector according to claim 1, wherein a strip connecting portion is formed by extending upward from the base and is configured to be connected to a strip, and the strip connecting portion is at least partially accommodated in a corresponding one of the accommodating grooves.

9. The electrical connector according to claim 1, wherein a supporting portion is formed by extending upward from the body and is configured to upward support the chip module, and the supporting portion is connected to one side of a corresponding one of the accommodating grooves.

10. The electrical connector according to claim 1, wherein the elastic portion comprises a first portion extending from the base toward a direction away from a vertical plane where the base is located, and a second portion formed by bending and extending reversely from the first portion to pass beyond the vertical plane where the base is located, the second portion has a contact portion abutting the chip module, and the first portion and the contact portion are located on two opposite sides of a corresponding one of the accommodating grooves accommodating the base.

11. The electrical connector according to claim 1, wherein the two adjacent accommodating holes in the front-rear direction are in communication with each other at an overlapping position thereof.

* * * * *